US008899591B1

(12) United States Patent
Donaldson

(10) Patent No.: US 8,899,591 B1
(45) Date of Patent: Dec. 2, 2014

(54) DUAL LAYER TARGET

(76) Inventor: Dale E. Donaldson, Roseville, MI (US)

( * ) Notice: Subject to any disclaimer, the term of this patent is extended or adjusted under 35 U.S.C. 154(b) by 184 days.

(21) Appl. No.: 13/444,607

(22) Filed: Apr. 11, 2012

(51) Int. Cl.
*F41J 1/00* (2006.01)

(52) U.S. Cl.
USPC ..... 273/409; 273/408

(58) Field of Classification Search
USPC ..... 273/378, 382, 403–410; 356/401
See application file for complete search history.

(56) References Cited

U.S. PATENT DOCUMENTS

| | | | | |
|---|---|---|---|---|
| 1,223,290 | A * | 4/1917 | Ravenshear | 273/409 |
| 2,090,930 | A | 8/1937 | Chubb | |
| 4,203,600 | A | 5/1980 | Brown | |
| 4,508,508 | A * | 4/1985 | Theodore | 434/19 |
| 4,810,561 | A | 3/1989 | King | |
| 5,160,133 | A | 11/1992 | Bloom | |
| 5,275,890 | A | 1/1994 | Wolf et al. | |
| 5,593,162 | A * | 1/1997 | Minuskin | 273/403 |
| 5,669,610 | A * | 9/1997 | Salyers | 273/407 |
| 6,019,375 | A | 2/2000 | West, Jr. | |
| 6,575,469 | B2 * | 6/2003 | Love | 273/403 |
| 7,207,567 | B1 | 4/2007 | Brown | |
| 2004/0036221 | A1 | 2/2004 | Martinez | |
| 2007/0046760 | A1 | 3/2007 | Zara | |
| 2007/0262529 | A1 | 11/2007 | Gamez et al. | |
| 2008/0054570 | A1 | 3/2008 | Potterfield et al. | |

FOREIGN PATENT DOCUMENTS

| | | | | |
|---|---|---|---|---|
| JP | 11135393 | A * | 5/1999 | H01L 21/02 |

* cited by examiner

*Primary Examiner* — Mark Graham
(74) *Attorney, Agent, or Firm* — Vincent Re PLLC

(57) ABSTRACT

A shooting target having two overlaid target sheets. The front sheet provides a user with a photorealistic image of a desired target object (e.g., game animal or human assailant). Behind the front sheet is another sheet having the same image thereon, but with portions of that target which represent vital organs superimposed over the appropriate portions of the target's body. Having the rear sheet that provides the user with the marksmanship feedback behind the visible target sheet provides a more realistic shooting experience by eliminating the "aim-points" of traditional targets. Further, the dual layer target produces a "souvenir" sheet that readily shows which vital organ was struck.

13 Claims, 4 Drawing Sheets

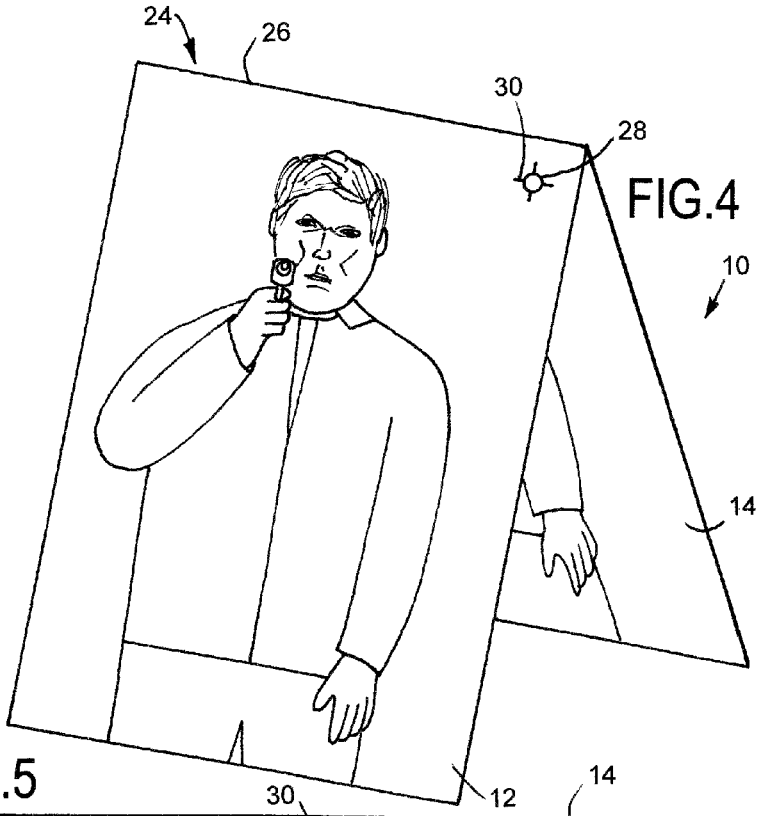
FIG.4
FIG.5
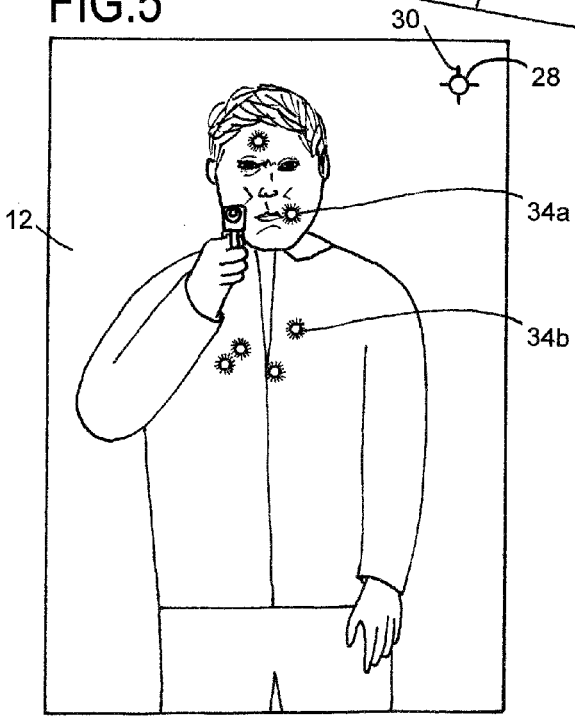
FIG.6
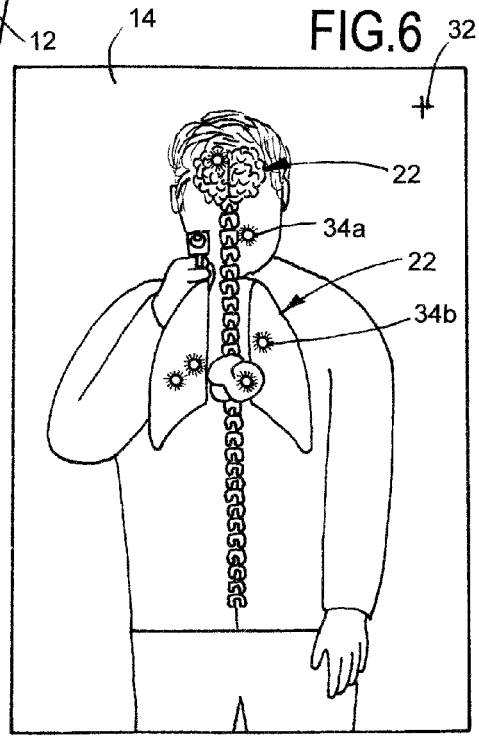

DUAL LAYER TARGET

FIELD OF THE INVENTION

This invention is related to shooting targets and more particularly to paper targets having vital organ regions to improve and teach shot selection skills.

BACKGROUND OF THE INVENTION

Practice is an essential component in any endeavor, including marksmanship in both firearms and archery. The practice of marksmanship, in either firearms or bow and arrow, uses targets to improve accuracy and precision. Typically, target practice occurs on a shooting range or other protected environment. Paper targets are widely used due to their low cost and portable nature. Paper targets also allow for the shooter to retain a well-shot target as a trophy or souvenir demonstrating the shooter's prowess.

Currently, paper targets have begun to mimic the size and shape of the intended target to give a degree of familiarity with the appropriate aim/target points of a real-life target. In the case of hunting targets, a target will often present a recognizable image of the game animal. Similarly, targets whose purpose is for self-defense, military, and police training will include the image of a would-be assailant. While these targets give a more realistic target for the shooter, they do not provide accuracy feedback to the shooter in the form of whether the practice shots have struck locations on the target that would incapacitate the target subject (e.g., the would-be target's vital organs).

More recent targets, including those in the prior art below, superimpose an outline of these vital organs over the target image to provide the "incapacitation" feedback to the shooter. While these prior art targets do provide feedback to the shooter, the outline of the target's vital organs can often be seen resulting in a virtual "bulls-eye" or aim-point that can be focused on. In other versions, the outline of the vital organs is very faint, which, while giving feedback to the shooter when viewed up-close, lacks the rewarding trophy aspect as only close inspection of the target will reveal the shooter's "true" accuracy.

Some prior art targets include U.S. Pat. No. 2,090,930 which issued Aug. 24, 1937 to William Chubb for a SMALL ARMS TARGET SCORING GAUGE AND TARGET discloses a dual layer target having a transparent layer having vital organs thereon which is laid over a traditional silhouette image.

United States Patent App. Pub. No. 2007/0262529 published on Nov. 15, 2007 to Jackie Gamez et al. for a MULTI-COLORED VISISHOT PAPER TARGET discloses another paper target with a plastic sheet overlay. In this target, the paper layer provides the vital or "effective" zones in high contrasting colors, while the overlay has a silhouette of the game animal covering the back layer.

U.S. Pat. No. 5,275,890 which issued C. Steven Wolf et al. for a GUN TARGET WITH CONTRASTING BACKING discloses dual layer target having a paper front layer and a plastic rear layer having a high contrast color. When the bullet passes through the target the plastic stretches/deforms slightly to produce a slightly smaller hole which gives a shooter visible ring within the bullet hole.

U.S. Pat. No. 7,207,567 which issued Apr. 24, 2007 to Jeffrey Brown for an ANATOMICAL WEAPONS QUALIFICATION TARGET discloses target having a faint anatomical structures within the image. These structures are invisible at a distance of seven yards, but are visible when closer.

While the above prior art target patents provide feedback to the shooter, there is still a need for a target that provides the realistic image of a would-be target along with the capacity to provide both a readily visible feedback and a reward aspect.

SUMMARY OF THE INVENTION

The broad purpose of the present invention is to provide a shooting target having two overlaying paper sheets. The first or front sheet provides a shooter with a photo-realistic image of a desired target object (i.e., game animal, human assailant, or pest animal/varmint). Behind the front sheet is a second or rear sheet having the same image thereon, but with portions of that target which represent vital organs superimposed over the appropriate portions of the target's body.

In one embodiment, the superimposed organs of the rear sheet are also photo-realistic. In other embodiments, the second sheet also includes supplemental information boxes, which provide details to the shooter about the physiological impact of hitting a particular organ.

The second sheet remaining behind the visible front target sheet provides a more realistic shooting experience by eliminating the "aim-points" of traditional targets where the user can zero in on a bulls-eye/organ outline. Further, the dual layer target produces a "souvenir" sheet that readily shows which vital organ was struck.

It is an advantage of the present invention to provide a dual layer target for marksmanship practice including a front planar sheet having a first photorealistic image of a target subject on a front surface and a rear planar sheet including a second photorealistic image that is substantially identical to the first photorealistic image and at least one anatomically correct vital organ feedback image that is superimposed over an anatomically correct location on the second photorealistic image. Wherein the first photorealistic image bears no additional aiming points thereon and the front planar sheet overlies the rear planar sheet such that the first and second images are precisely aligned while blocking the organ feedback images from view.

It is another advantage of the present invention to provide a target for marksmanship practice comprising a first planar sheet having a first photorealistic image of a target subject on a front surface and a second planar sheet including a second photorealistic image that is substantially identical to the first photorealistic image and at least one photorealistic image of a vital organ that is superimposed over an anatomically correct location on the second photorealistic image. Wherein the first planar sheet overlies the second planar sheet such that the first and second images are precisely aligned.

Still further objects and advantages of the invention will become readily apparent to those skilled in the art to which the invention pertains upon reference to the following detailed description.

BRIEF DESCRIPTION OF THE DRAWINGS

The description refers to the accompanying drawings in which like reference characters refer to like parts throughout the several views and in which:

The drawings described herein are for illustrative purposes only of selected embodiments and not all possible implementations, and are not intended to limit the scope of the present disclosure.

FIG. 4 is a perspective view of the attached front and rear layers form the dual layer target of FIGS. 1-3;

FIG. 5 is a front view of a dual layer target of FIGS. 1-4, showing the front layer having holes therein as a result of target practice;

FIG. 6 is a front view of the rear layer of the dual layer target shown in FIG. 5, the holes in the rear layer being substantially aligned with the holes in the front layer;

Corresponding reference numerals indicate corresponding parts throughout the several views of the drawings. Example embodiments will now be described more fully with reference to the accompanying drawings.

DETAILED DESCRIPTION OF THE INVENTION

Figure 1:
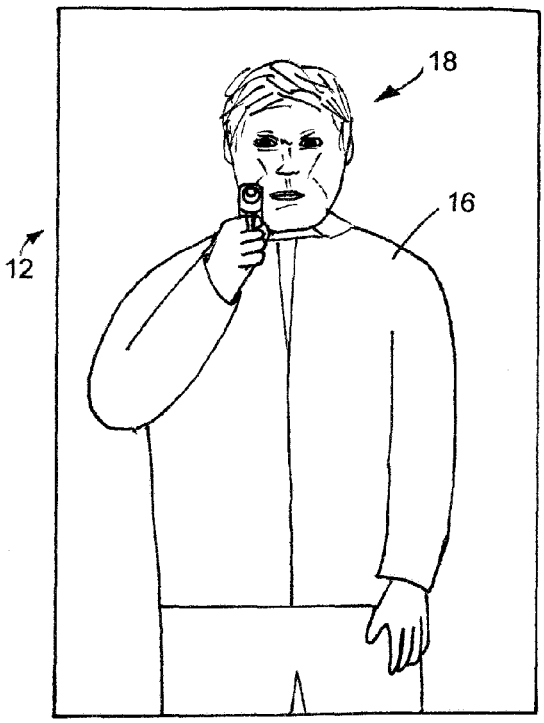
FIG. 1 is front view of the front layer of one embodiment of the of the present invention depicting a human assailant image.

Referring now to the FIGS., with initial reference to FIGS. 1-6, a dual layer target 10 is shown having a target or front layer 12 that overlies a rear layer 14. Front layer 12 includes a print image 16 of a desired target subject 18. In the embodiment illustrated in FIGS. 1-7, the target subject 18 is a human assailant, while in the embodiment illustrated in FIGS. 8-10, the target subject, denoted 118, is a game animal (e.g., a buck). The combination feedback and souvenir layer 14, also denoted "rear layer" includes a print image 20 that is substantially identical to the image 16 of the front layer 12, but with the addition of shooter feedback regions 22 superimposed over portions of the image 20. In the preferred embodiment both front layer 12 and rear layer 14 are planar sheets of a paper stock material.

FIG. 1 is a front view of the front layer 12 of shooting target 10 for practicing shot placement by a shooter in accordance with the preferred embodiment of the invention. The front layer 12 is preferably a planar sheet and includes a print image 16. The first print image 16 includes a least one photorealistic rendering of a human 18. The print image 16 is preferably present on layer 12 as either an printed photographic image, a laser-printed surface, a painted surface, etc. providing a realistic image to the shooter. The target rendering 18 is of a would-be assailant in one of a variety of threatening positions (e.g., brandishing a firearm).

The human shape 18 is preferably a photograph or other photorealistic image having characteristic features that impart a recognizable and/or realistic appearance. In this specific embodiment, the human shape 18 may be a photograph taken of the desired target subject. In other embodiments, a realistic illustration or painting may depict the subject 18. In further embodiments, the subject's shape 18 may be a simple drawing or cartoon that includes characteristic features of the representative target.

To improve the shooter's accuracy and to gain familiarity in firing upon a subject 18 without any visual aids or cues, the front layer's print image 16 presents a only the image of the target subject 18 without any aiming points or other overlaying points of reference. To the shooter, the front layer 12 solely presents a realistic, preferably photographic quality, image of an assailant 18.

Figure 2:
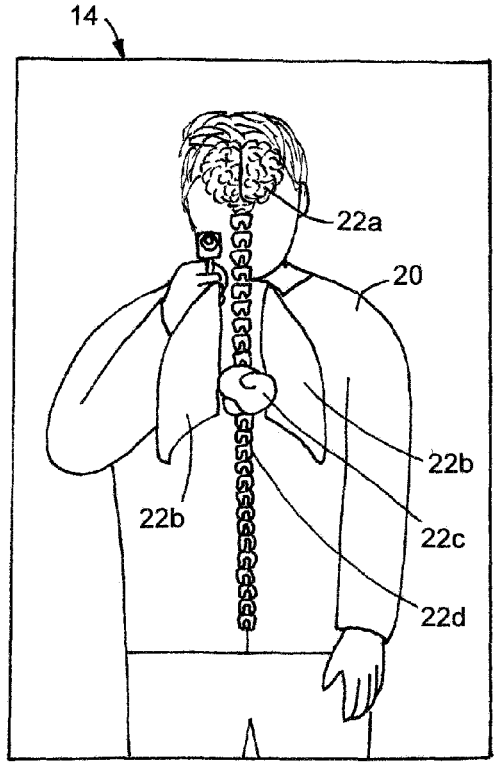
FIG. 2 is a front view of the rear layer of the embodiment of present invention shown in FIG. 1.

FIG. 2 is a front view of the rear layer 14 of shooting target 10. The rear layer 14 has a second print image 20 that is substantially identical to the first print image 16 and may include an anatomically accurate illustration of shooter feedback regions comprising in this embodiment, internal organ structures 22*a*-22*c* (collectively referred to as 22). In the non-limiting examples illustrated in the FIGS. only some vital organs, such as the brain 22*a*, lungs 22*b*, heart 22*c*, and spine 22*d* are shown, but the present invention provides for substantially any vital internal structures (i.e., those internal structures that would lead to the simulated target's incapacitation) could be provided, including circulatory systems and other skeletal structures.

These feedback regions overlie the second print image 20 in the anatomically correct position based upon the relative perspective of the target presented by the image 16, 20. That is, the size, angle and position of the internal organs 22 will depend on the body position of the target subject 18 shown in the front image 16. In the preferred embodiment, the vital organs 22 are illustrated in photorealistic form to increase the trophy or souvenir potential of the rear layer. In other embodiments, feedback regions are simple outlines of the respective organs.

Figure 3:
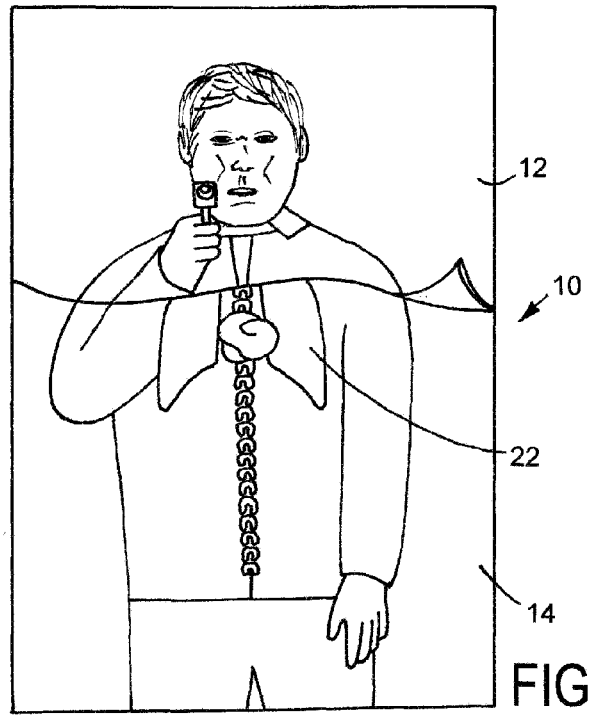
FIG. 3 is a partial cut-away view of the dual layer target of FIGS. 1-2.

As best shown in FIG. 3, the front layer 12 overlies the rear layer 14 such that the two images 16, 20 are aligned facing a shooter such that removing a portion of the front layer 12 will not disturb the target picture presented to the shooter. In the preferred embodiment, the two layers 12, 14 are attached along one edge, such as top edge 24, by a conventional adhesive material 26, such as padding compound which permit the two layers 12, 14 to be readily separated. In other embodiments, the layers 12, 14 may be mechanical coupled together, e.g., stapled. As shown in FIGS. 4 and 5, the target layers 12, 14 may include alignment legends, such as a small hole 28 with radially projecting alignment lines 30 on front layer 12, while rear layer includes a crosshair mark 32 which can be readily aligned through hole 28 to be linearly coextensive with lines 30. In other embodiments, such as the one depicted in FIGS. 8 and 9, identical solid lines or bars 33 are spaced around the periphery of each layer 12, 14 to ensure that the front and rear layers are aligned prior to shooting. In this manner, if the layers 12, 14 become separated, a user can readily re-align the overlaying layers for accurate feedback from the dual layered target 10. To ensure alignment, more than one alignment legend may be provided in a dual layer target 10.

As illustrated in FIGS. 5 and 6, in operation, a shooter is presented by only the photorealistic image 16 of subject 18 while practicing. Upon completing their target practice, the shooter can retrieve the target 10 and separate the two layers 12, 14. Once separated, the shooter can quickly and easily determine whether he/she was successful in hitting the desired feedback regions 22 by looking at the ballistic holes 34*a*, 34*b* formed in the two layers. By presenting only the subject target 18 to the shooter, the shooter is taught to recognize real-world aiming reference points and not rely on the practice target's feedback regions 22, which are hidden by the overlying front sheet 12.

Figure 7:
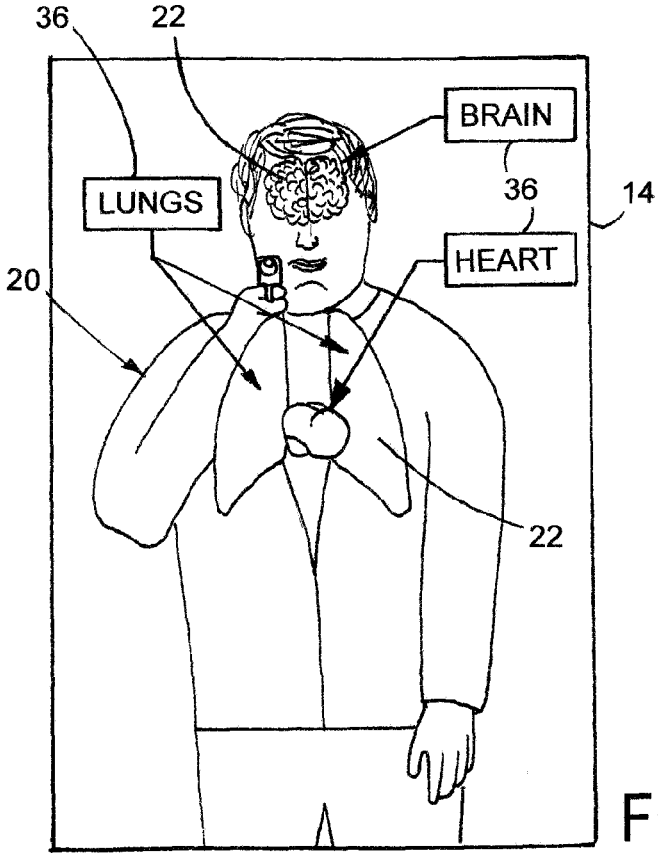
FIG. 7 is an alternate embodiment of the rear layer illustrating vital organ information indicia to give the shooter additional feedback from the practice session.

In another embodiment, shown in FIG. 7, the rear layer 14 also includes information indicia 36 located around the target subject image 20. Information indicia 36 provides the shooter with relevant information related to the physiological impact on a target (i.e., the assailant) for additional feedback. For example, the indicia 36 for an internal organ, such as the lungs, may provide the likely trauma/effect that a variety of caliber bullets hitting that organ would cause.

Figure 10:
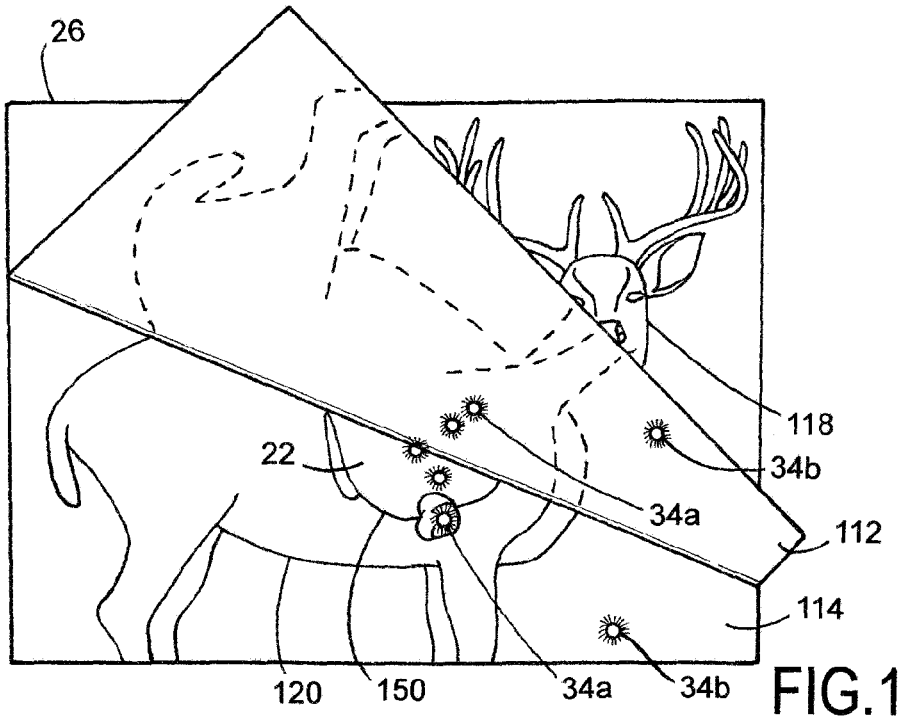
FIG. 10 is a front view of the embodiment illustrated in FIGS. 8-9 with the front layer folded upward revealing the aligned rear layer.
Figure 8:
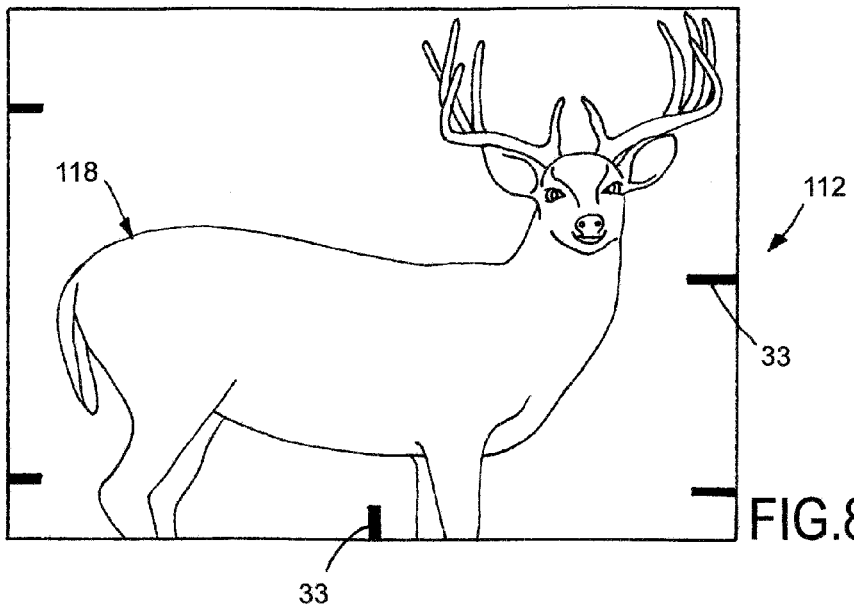
FIG. 8 is a front view of a front layer of an alternate embodiment of the present invention depicting a game animal image.
Figure 9:
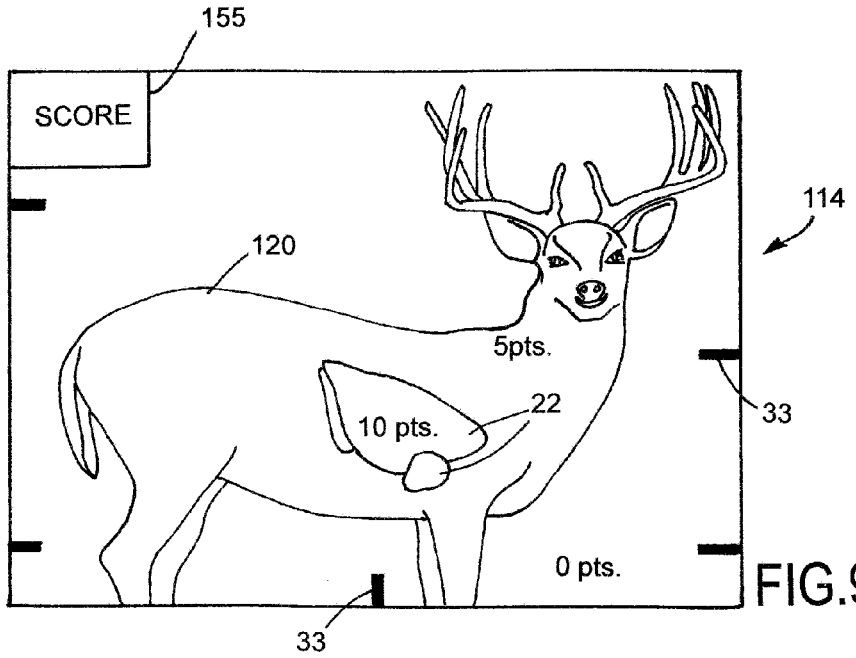
FIG. 9 is a front view of the rear layer of the embodiment of present invention shown in FIG. 8.

As illustrated in the embodiment shown in FIGS. 8-10, the dual layer target 10 may include a simulated image 16 of an animal or hunting target such as the animal shape 118. In the exemplary embodiment illustrated, the animal shape 118 is of a buck in a broadside perspective view. One of ordinary skill in the art will recognize that a variety of animal shapes, including animal shapes depicted in a wide array of positions (e.g., perspective views, front views, top views, rear views), may be shown including, but not limited to, game animals (e.g., deer, moose, elk), birds (e.g., ducks, pheasant, wild turkey), or varmints/pest animals (e.g., coyote, prairie dogs, rabbits). The animal shape 118 may be sized to full-scale or may be less or more than full-scale. Accordingly, the animal shape 118 representing a buck may be sized according to the buck's authentic size on the target's image 16. In other embodiments, the target image 16 may have the animal shape 118 sized differently than full-scale (e.g., smaller or larger than the animal's authentic size). In one non-limiting embodiment, the image 18, 118 is sized based on a common engagement distance taking into account the typical practice range's size/capacity and the use of magnifying optics (i.e., rifle scopes). For example, the image 118 may be sized expecting a "real world" engagement distance of 100 yards, while taking into account that some practice ranges have 50 yard capacities and the common use of 4× power rifle scopes.

The animal shape 118 is preferably a photograph or other photorealistic image having characteristic features that impart a recognizable and/or realistic appearance. In this specific embodiment, the animal shape 118 may be a photograph taken of the desired target representative animal. In other embodiments, a realistic illustration or painting may depict the animal shape 118, color, and/or characteristic features. In further embodiments, the animal shape 118 may be a simple drawing or cartoon that includes characteristic features 123 of the representative animal, target or target shape.

Like the human subject target described above, the front layer 112 only depicts the realistic animal target image 118. The rear layer 114 includes a substantially identical image 120 to image 118, but further includes one or more illustrations of the internal organ structures 122 (e.g., heart, lungs, liver, spine, other skeletal features, etc.) superimposed over the anatomically correct position on the rear image 120. Layer 112 is aligned and coupled by adhesive 26 to fully overlay layer 114, such that their corresponding animal images 118, 120 are aligned and the feedback regions 122 of layer 114 are in a generally anatomically correct position relative to the front layer's image 118. In this manner, when a shooter's projectile (bullet) passes through the front layer 112, the resulting holes 34*a*, 34*b* are in the same location on the two substantially identical images 118, 120. In one embodiment, the illustrations of the internal organ structures 134 may include an outline of the one or more internal organ structures. In some arrangements, the a contrasting colored border or outline 150 surround the feedback regions 22 so that the outlines of the internal organ structures are readily distinct from the coloring of the animal shape 120.

In other embodiments, the feedback regions 22 are not limited to only vital organs, but include additional internal anatomic features such as skeletal structures, other organs, muscle groups, veins and arteries. In still other embodiments, multiple rear layers 14 may be overlaid by a front layer 12. Each additional rear layer may include different and additional internal anatomic features and/or separating the vital organs 22 into distinct layers 14 of a single target 10.

In still other embodiments, the target 10 may include a scoring system 155 similar to a traditional bull's-eye scoring ring with the various feedback regions 22, target image 120, and target 10 itself assigned point value which can be added for competitive purposes and/or tracking a shooter's accuracy over different practice sessions.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the FIGS. Spatially relative terms may be intended to encompass different orientations of the target 10 in use or operation in addition to the orientation depicted in the FIGS. For example, if the target 10 in the FIGS is turned over, elements described as "below" or "beneath" other elements or features would then be oriented "above" the other elements or features. Thus, the example term "below" can encompass both an orientation of above and below. The target 10 may be otherwise oriented (rotated 90 degrees or at other orientations) and the spatially relative descriptors used herein interpreted accordingly.

From the foregoing description, one skilled in the art will readily recognize that the present invention is directed to a dual layer shooting target having a front layer having a photo-realistic image of a target subject, such as a game animal or human assailant. A second rear layer is overlaid by the front layer and has substantially the same photo-realistic image as the front sheet, but superimposed over the anatomically appropriate regions of the image are the image of the target's various vital organs. While the present invention has been described with particular reference to various preferred embodiments, one skilled in the art will recognize from the foregoing discussion and accompanying drawings that changes, modifications, and variations can be made in the present invention without departing from the spirit and scope thereof.

The invention claimed is:

1. A target for marksmanship practice comprising:

the target, wherein the marksmanship practice comprises firearm marksmanship practice, comprising:

a front planar disposable paper sheet comprising a first target image of a target subject on a front surface of the front planar sheet, the image bearing no additional aiming points thereon; and a rear planar disposable paper sheet comprising a second target image including at least one vital organ on a front surface of the rear planar sheet corresponding to the image on the front planar sheet;

wherein the front planar disposable paper sheet and the rear planar disposable paper sheet are separable from each other to enable a shooter to, upon lifting the front planar disposable paper sheet from the rear planar disposable paper sheet, examine results upon the rear planar disposable paper sheet; and wherein said front planar sheet and said rear planar sheet are configured to train the shooter to hit the vital organ upon a similar target when no vital organ is apparent to the shooter;

wherein said front planar disposable paper sheet and said rear planar disposable paper sheet are attached together along a top edge with a padding compound configured to permit said front planar sheet and said rear planar sheet to be aligned along the entire top edge and be easily separable.

2. A target as defined in claim 1, wherein said image of the target subject depicts a human assailant.

3. A target as defined in claim 1, wherein said image of the target subject depicts a game animal.

4. A target as defined in claim 1, wherein said image on said rear planar disposable paper sheet comprises a plurality of images of vital organs.

5. A target as defined in claim 1, wherein said image on said rear planar disposable paper sheet comprises an outline image of the at least vital organ of said target subject.

6. A target as defined in claim 1, wherein said front planar disposable paper sheet and said rear planar disposable paper sheet include means for realigning the images if the front and rear sheets are separated.

7. A target as defined in claim 6, wherein said realignment means includes crosshairs printed onto said rear planar disposable paper sheet which are visible through a hole formed through the front planar disposable paper sheet and includes radially projecting lines which are linearly coextensive with the crosshairs when the sheets are realigned.

8. A target for marksmanship practice comprising:

the target, wherein the marksmanship practice comprises firearm marksmanship practice, comprising:

a first planar disposable paper sheet having a first photorealistic image of a target subject on a front surface, the first photorealistic image bearing no additional aiming points thereon;

a second planar disposable paper sheet including a second photorealistic image that is substantially identical to the first photorealistic image and at least one photorealistic image of a vital organ that is superimposed over an anatomically correction location on the second photorealistic image; and a third planar disposable paper sheet including a third photorealistic image that is substantially identical to the first photorealistic image and at least one photorealistic image of another vital organ that is superimposed over an anatomically correct location on the third photorealistic image;

wherein said first planar disposable paper sheet overlies said second planar disposable paper sheet such that said first and second images are precisely aligned; and wherein the first planar disposable paper sheet and the second planar disposable paper sheet are separable from each other to enable a shooter to, upon lifting the first planar disposable paper sheet from the second planar disposable paper sheet, examine results upon the second planar disposable paper sheet; and wherein said first planar sheet and said second planar sheet are configured to train the shooter to hit the vital organ upon a similar target when no vital organ is apparent to the shooter.

9. A target as defined in claim 8, wherein the first planar disposable paper sheet substantially blocks said image of said vital organ from view when said first planar disposable paper sheet overlies said second planar disposable paper sheet.

10. A target as defined in claim 8, wherein said first and second photorealistic images depict a human assailant.

11. A target as defined in claim 8, wherein said first and second photorealistic images depict a game animal.

12. A target as defined in claim 8, further comprising means for visually aligning the first and second sheets, such that the first and second images remain precisely aligned immediately prior to shooting at the target.

13. A target as defined in claim 12, further comprising crosshairs printed onto said second sheet which are visible through a hole formed through the first sheet and includes radially projecting lines which are linearly coextensive with the crosshairs when the sheets are realigned.

* * * * *